US012377313B2

(12) United States Patent
Singh et al.

(10) Patent No.: US 12,377,313 B2
(45) Date of Patent: Aug. 5, 2025

(54) ANCHOR BAR AND CARRIAGE STOP ASSEMBLY

(71) Applicant: Balanced Body, Inc., Sacramento, CA (US)

(72) Inventors: Harbir Singh, Roseville, CA (US); Trent Canales, Roseville, CA (US)

(73) Assignee: Balanced Body, Inc., Sacramento, CA (US)

( * ) Notice: Subject to any disclaimer, the term of this patent is extended or adjusted under 35 U.S.C. 154(b) by 58 days.

(21) Appl. No.: 18/588,743

(22) Filed: Feb. 27, 2024

(65) Prior Publication Data

US 2024/0374957 A1 Nov. 14, 2024

Related U.S. Application Data

(60) Provisional application No. 63/465,391, filed on May 10, 2023.

(51) Int. Cl.
*A63B 22/20* (2006.01)
*A63B 21/00* (2006.01)
*A63B 21/04* (2006.01)

(52) U.S. Cl.
CPC ..... *A63B 22/203* (2013.01); *A63B 21/00069* (2013.01); *A63B 21/0428* (2013.01)

(58) Field of Classification Search
CPC ..... A63B 22/203; A63B 21/00069; A63B 21/0428; A63B 21/00065; A63B 21/023; A63B 21/4045; A63B 22/0087; A63B 22/0089
See application file for complete search history.

(56) References Cited

U.S. PATENT DOCUMENTS 5,681,249 A * 10/1997 Endelman ..... A63B 21/154 482/133
6,120,425 A * 9/2000 Endelman ..... A63B 23/03525 482/142
6,338,704 B1 * 1/2002 Endelman ..... A63B 21/023 482/133
6,685,606 B2 * 2/2004 Endelman ..... A63B 23/0405 482/121
7,125,368 B2 * 10/2006 Endelman ..... A63B 21/055 482/121
7,163,500 B2 * 1/2007 Endelman ..... A63B 21/04 482/142
7,288,054 B2 * 10/2007 Endelman ..... A63B 23/03525 482/121

(Continued)

*Primary Examiner* — Andrew S Lo
(74) *Attorney, Agent, or Firm* — Greenberg Traurig, LLP

(57) ABSTRACT

A reformer has parallel tracks extending between a head end and a foot end and an anchor bar and carriage stop assembly fastened to the frame adjacent the foot end of the frame. The assembly includes an anchor bar slidably fastened to a pair of elongated plates each fastened to one of the tracks. Each plate has an elongated closed slot therein extending parallel to and below the one of the tracks. The anchor bar has opposite ends, each end extending through one of the elongated slots and through an elongated spacer member pivotally fastened to the end of the anchor bar. Each elongated spacer member has a distal end carrying a pin fastened thereto extending through the elongated slot, wherein the pin has a carriage stop fastened to the pin.

4 Claims, 4 Drawing Sheets

(56) References Cited

U.S. PATENT DOCUMENTS

| | | | | |
|---|---|---|---|---|
| 8,152,705 | B2 * | 4/2012 | Rooks | A63B 22/0087 482/142 |
| 8,663,074 | B2 * | 3/2014 | Uygan | A63B 21/00185 482/130 |
| 9,108,079 | B2 * | 8/2015 | Solow | A63B 22/0089 |
| 9,675,833 | B2 * | 6/2017 | Solow | A63B 21/023 |
| 11,065,495 | B1 * | 7/2021 | Savarino | A63B 21/023 |
| 11,896,869 | B2 * | 2/2024 | Elliott | A63B 21/154 |
| 2003/0119636 | A1 * | 6/2003 | Endelman | A63B 21/023 482/142 |
| 2005/0113227 | A1 * | 5/2005 | Endelman | A63B 22/001 482/130 |
| 2010/0004101 | A1 * | 1/2010 | Solow | A63B 21/4039 482/96 |
| 2021/0128975 | A1 * | 5/2021 | Elliott | A63B 21/0428 |

* cited by examiner

ANCHOR BAR AND CARRIAGE STOP ASSEMBLY

CROSS REFERENCE TO RELATED APPLICATIONS

This application claims the benefit of priority to U.S. Provisional Patent Application Ser. No. 63/465,391, filed May 10, 2023, the content of which is incorporated by reference in its entirety.

BACKGROUND OF THE DISCLOSURE

Field of the Disclosure

The present disclosure relates to an exercise apparatus used in Pilates type exercises. In particular, this disclosure relates to a new anchor bar and carriage stop assembly for use in a reformer exercise apparatus.

State of the Art

Exercise machines utilized in the performance of physical exercises originated by Joseph Pilates typically are often performed on a stationary apparatus called a reformer. A reformer typically has a rectangular wood or metal frame having a foot end and a head end. A pair of parallel side rails separates the head and foot ends. A rolling carriage is configured to roll along between the side rails from the foot end to the head end and is biased toward the foot end of the frame by one or more coil springs connected to an anchor bar fastened to the frame near the foot end and to the carriage. A foot bar is fastened to the foot end of the frame. A user typically sits or reclines on the carriage and pushes against the foot bar to move the carriage away from the foot end of the frame during exercise. There are a variety of mechanisms to vary the distance between the carriage and the foot end when the carriage is at a rest position. Exemplary mechanisms are disclosed in our U.S. Pat. Nos. 7,163,500 and 11,065,495.

Some reformers have a member fastened to an inner surface of the side rails to form a track on which the carriage rolls between the head and foot ends of the reformer frame. Typically such reformers may also have a plurality of holes in the members into which a carriage stop block may be placed to maintain a certain distance between the anchor bar and the carriage. Often such anchor bar support assemblies require modification of existing anchor bar support brackets, etc. Thus there is still a need for a simple anchor bar and carriage stop assembly that can be installed on any such reformer.

SUMMARY OF THE DISCLOSURE

A reformer exercise apparatus in accordance with the present disclosure includes a generally rectangular frame, a carriage on the frame configured for movement back and forth between a head end and a foot end of the frame on parallel tracks, one or more bias members fastened between the carriage and an anchor bar carried at the foot end of the frame for biasing the carriage toward the foot end of the frame on the parallel tracks, a foot bar fastened at or adjacent to a foot end of the frame, and an anchor bar and carriage stop assembly fastened to the frame adjacent the foot end of the frame. The one or more bias members, such as an elongated coil spring, is carried in the anchor bar and carriage stop assembly.

This anchor bar and carriage stop assembly includes an anchor bar slidably fastened to a pair of elongated plates each of which is fastened to one of the tracks fastened to or constituting a side of the frame. Each elongated plate has an elongated closed slot therein extending parallel to and below the one of the tracks to which the elongated plate is fastened. This elongated slot has a set of spaced apart downwardly extending notches along its length The anchor bar is a tubular or solid cylindrical body that has opposite ends, each end having an axle extending through one of the elongated slots and through a proximal end of an elongated spacer member pivotally fastened to the end of the anchor bar. Each elongated spacer member has a distal end carrying a pin fastened thereto extending through the elongated slot in the respective one of the elongated plates. This pin in turn has a carriage stop fastened to the pin.

When the assembly is mounted to the foot end of a reformer exercise apparatus, the anchor bar may be moved between the notches to position the anchor bar at different distances from the foot end of the frame determined by the notch positions, while at the same time, the carriage stop fastened to the pin also protruding through the elongated closed slot, maintains the carriage at a predetermined minimum distance from the anchor bar at all times. This arrangement permits persons of different heights to use the reformer exercise apparatus appropriately for their particular size while maintaining proper leg angle orientation with regard to position of the foot support bar or foot support plate.

DETAILED DESCRIPTION

Figure 1:
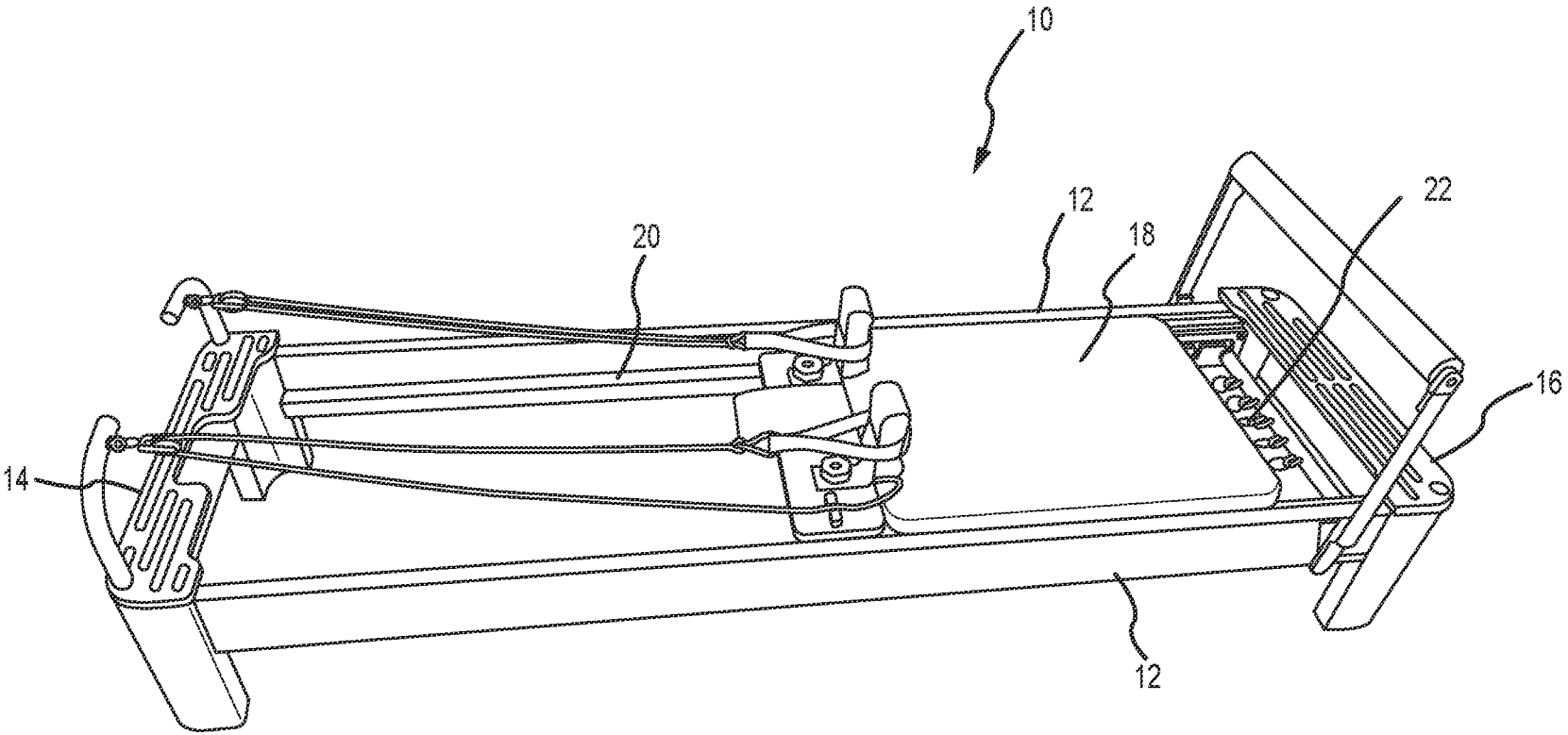
FIG. 1 is a perspective view of a reformer exercise apparatus having an anchor bar and carriage stop assembly in accordance with the present disclosure.
Figure 2:
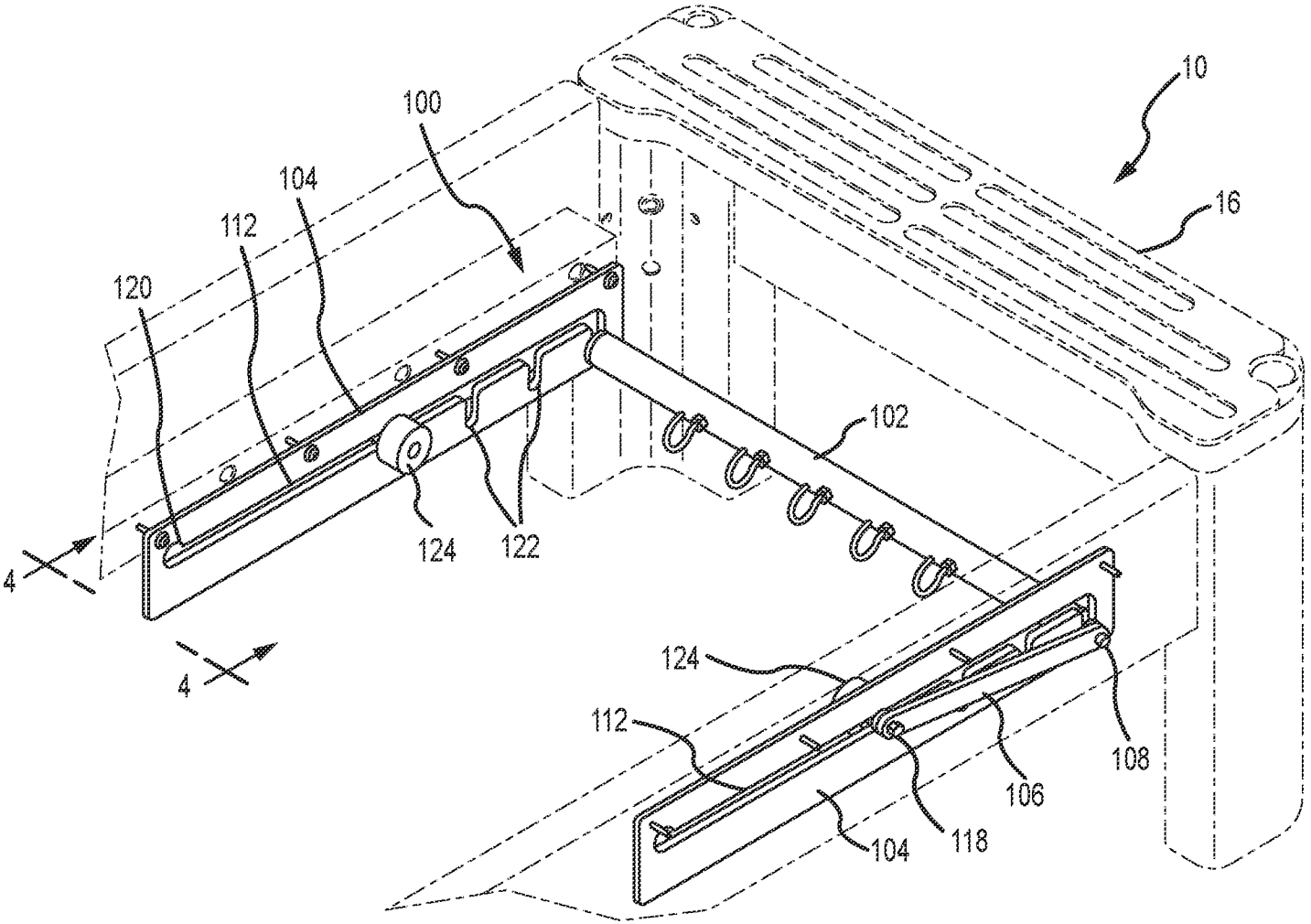
FIG. 2 is a perspective view of the foot end of the exercise apparatus shown in FIG. 1 with the frame and foot end shown in phantom.

One exemplary embodiment of an anchor bar and carriage stop assembly 100 installed for use on a reformer exercise apparatus 10 in accordance with the present disclosure is shown in FIG. 1. An enlarged view of the anchor bar and carriage stop assembly 100 installed at the foot end portion of the apparatus 10 is shown in FIG. 2 with the sides 12 and foot end 16 shown in phantom lines. The reformer 10 includes a pair of parallel sides 12 that extend parallel between a head end 14 and a foot end 16 of the generally rectangular reformer frame. A carriage 18 rides back and forth between the head end 14 and foot end 16 on tracks 20 that either are integral with or fastened to the sides 12 of the reformer frame. One or more coil springs 22 are typically fastened to and biased between the carriage 18 and the foot end 16.

The anchor bar and carriage stop assembly 100 includes a generally cylindrical spring anchor bar 102, two rectangular guide plates 104 and two spacer members 106, each attached to an opposite end of the anchor bar 102. Each of the guide plates 104 has a central elongated longitudinal closed slot therein and is adapted to be fastened to an inside or inner facing surface of one of the tracks 20 of the reformer 10 near the foot end 16 of the reformer 10. The anchor bar 102, shaped somewhat like a baker's rolling pin, has opposite ends each having an axle 108 protruding axially from the anchor bar 102. Each axle 108 carries a first bearing bushing or roller 110 that rolls or slides in the elongated closed slot 112 that extends longitudinally in each guide plate 104.

Also attached to the distal end of the axle 108 is a connecting arm or spacer member 106 pivotably connected to the axle 108. This spacer member 106 extends alongside and parallel to the guide plate 104 on an opposite side of the guide plate 104 from the anchor bar 102 and is positioned below the track 20 when the assembly 100 is fastened to the tracks 20 of a reformer 10. The distal end 116 of the spacer member 106 has a pin member 118 fastened thereto that extends parallel to the anchor bar 102 and carries a second bearing bushing roller 110 that also rides in the same closed slot 112.

Attached to the pin member 118 is a carriage stop block 124. This carriage stop block 124 engages a portion of the carriage 18 to prevent the carriage from getting too close to the anchor bar 102. This pin member 118 may be removably fastened to the distal end 116 of the spacer member 106 and preferably carries the second bearing roller 110 that also rides in the longitudinal closed slot 112. Alternatively the pin member 118 may be fastened to a carriage stop block 124 so as to extend through the second bearing roller 110 and the closed slot 112 to the spacer member 106.

One end of each of the closed slots 112 has an enlarged aperture 120 sized to receive and retain one portion of each of the bearing rollers 110 therethrough. Each closed slot 112 has a general width less than the enlarged aperture 120 so that, once installed, the bearing rollers 110 are each captured and retained within one of the closed slots 112. Each closed slot 112 includes a plurality of spaced apart stop notches 122 that extend down generally at a right angle from the longitudinal axis of the closed slot 112 and may optionally be angled at an acute angle from the longitudinal axis of the closed slot 112 so as to inhibit unintentional disengagement of the bearing roller 110 and axle 108 from the notch 122. Each of these notches 122 corresponds to a predetermined distance from the foot end 16 of the reformer exercise apparatus 10 when the assembly 100 is installed.

Attached to the pin member 118 is a carriage stop block or cushion cap 124. This stop block 124 is configured to abut against the carriage 18 to maintain a predetermined distance between the anchor bar 102 and the carriage 18 while the anchor bar 102 is moved from one stop notch 122 to another along the length of the closed slot 112.

Figure 4:
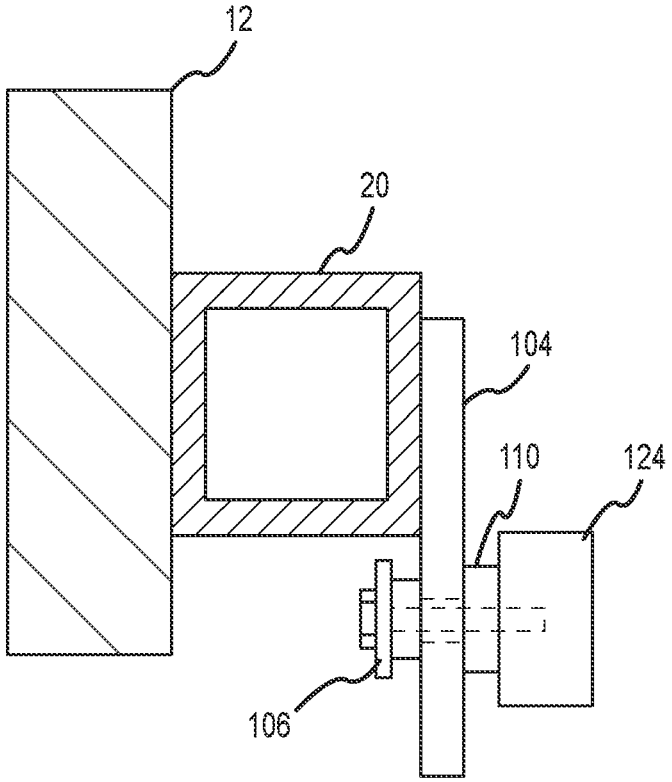
FIG. 4 is a cross section view of the reformer shown in FIG. 1 taken on the line 4-4 in FIG. 1.

This guide plate 104 is configured to be screwed or otherwise fastened to the track 20 of the side rail 12 of the reformer exercise apparatus 10 so that the elongated slot 112 extends alongside and parallel to and below the track 20. FIG. 4 shows a cross sectional view of one side 12 of the reformer 10 with the assembly 100 installed. Each elongated guide plate 104 of assembly 100 is essentially fastened to one side of the track 20 such that the spacer member 106 and carriage stop block 124 are below and adjacent the track 20. Not shown is a corner of the carriage 18 that preferably includes a bracket or portion of the carriage 18 that engages the stop block 124.

Figure 3:
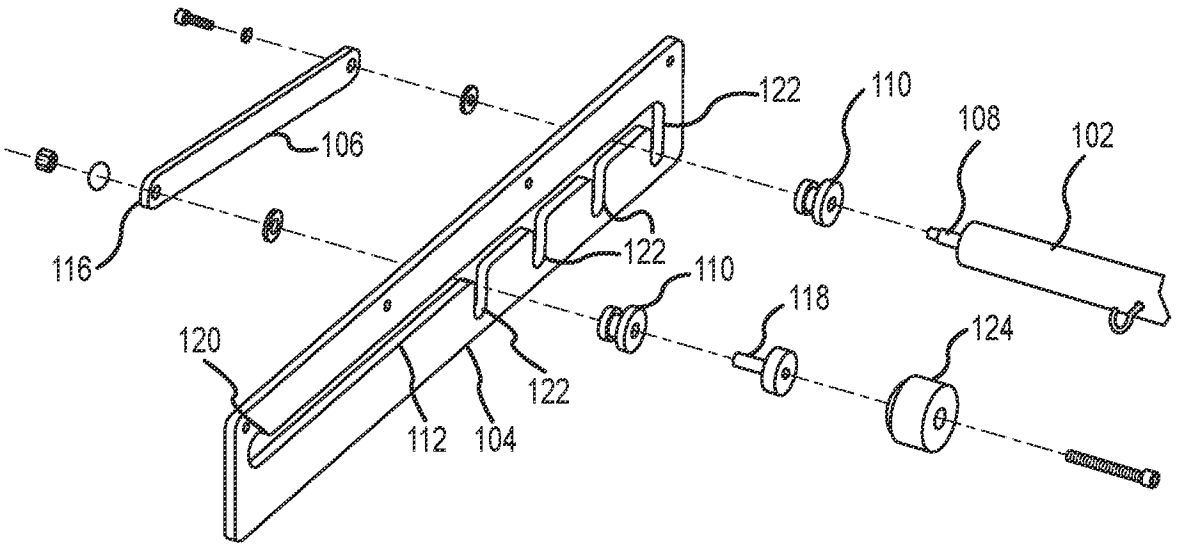
FIG. 3 is an exploded view of one side of the assembly in accordance with the present disclosure.

Referring now to FIGS. 3 and 4, each bearing bushing roller 110 has different inner, middle and outer diameter disc portions. The inner portion of each bearing bushing roller 110 has a first diameter larger than the width of the slot 112 but less than the diameter of the enlarged aperture 120 at one end of the closed slot 112. The mid or middle diameter disc portion is sized to readily slide along the closed slot 112 without binding. The second or outer disc portion of each bearing roller 110 is greater in diameter for butting against the side of the closed slot 112 and against either the carriage stop block 124 or the anchor bar 102 to which the bearing roller 110 is attached. This essentially captures each of the bearing bushing rollers 110 in its closed slot 112. Because the spacer member 106 has one end fastened to the axle 108 of the anchor bar 102 and the other end fastened to the pin member 118 carrying the stop block 124, movement of the anchor bar 102 along the slot 112 necessarily moves the pin member 118 and the stop block 124 along the slot 112.

In order to adjust the longitudinal position of an anchor bar 102 with respect to the foot end 16 of the reformer 10, utilizing the assembly 100 in accordance with the present disclosure, a user simply manually lifts up the anchor bar 102 and slidably moves the anchor bar 102 along the parallel slots 112 in each of the plates 104 from one stop notch 122 to an adjacent stop notch 122 and then lowers the anchor bar 102 into the appropriate stop notch 122. This automatically also moves the carriage 18 along with the anchor bar 102 thereby maintaining a constant minimum distance between them.

The assembly 100 in accordance with the present disclosure may be installed in any reformer exercise apparatus and the spring anchor bar will always be kept aligned and parallel, maintaining the same minimum distance from the carriage 18. The anchor bar 102 in the present assembly 100 cannot rotate down so as to inadvertently release a spring 22 if there is no tension on the spring 22. Downward and upward rotation of the anchor bar 102 is simply constrained by the height of the particular notch 122 in the slot 112 in which the anchor bar 102 is carried. The arrangement with the stop blocks 124 always being in a fixed orientation with respect to the anchor bar 102 and the spacer member 106 also ensures that the assembly moves only parallel to the tracks 20, and without binding.

A number of variations of the above assembly are envisioned. For example, the arrangement or positioning of the bearing bushing rollers 110 on the axles 108 and pins 118 may be reversed, i.e. with the greater second disc diameter portions facing the rail 20, for example, rather than toward the axle or stop block or bumper. Alternatively a bearing bushing roller 110 may be constructed from three different diameter discs stacked together or constructed from two spaced washers on a common axle for the mid portion instead of providing a mid portion that can roll along the axle. Accordingly, all such alternatives, variations and modifications are intended to be encompassed within the scope of and as defined by the following claims.

What is claimed is:

1. A reformer exercise apparatus comprising:

a frame;

a carriage on the frame configured for movement back and forth between a head end and a foot end of the frame on parallel tracks;

one or more bias members fastened between the carriage and the foot end of the frame for biasing the carriage toward the foot end of the frame on the parallel tracks;

a foot bar fastened at a foot end of the frame; and an anchor bar and carriage stop assembly fastened to the frame adjacent the foot end of the frame having an anchor bar slidably fastened to a pair of elongated plates each fastened to one of the tracks, each plate having an elongated closed slot therein extending parallel to and below the one of the tracks, wherein the anchor bar has opposite ends, each end extending through one of the elongated slots and through an elongated spacer member pivotally fastened to the end of the anchor bar, each elongated spacer member having a distal end carrying a pin fastened thereto extending through the elongated slot, wherein the pin has a carriage stop fastened to the pin.

2. The reformer exercise apparatus according to claim 1 further comprising a first bearing roller fastened to each end of the anchor bar, each first bearing roller having a portion riding in the closed slot.

3. The reformer exercise apparatus according to claim 2 further comprising a second bearing roller fastened to each pin on the distal end of the spacer member, each second bearing roller riding in the elongated closed slot.

4. An anchor bar and carriage stop assembly for use in a reformer exercise apparatus having a rectangular frame and a pair of parallel tracks extending between a head end and a foot end of the rectangular frame, the anchor bar and carriage stop assembly comprising:

an anchor bar having opposite ends;

a pair of elongated spacer members, each pivotally fastened to one of the anchor bar ends;

a pair of elongated plates, each plate having a central longitudinal closed slot and adapted to be fastened to one of the tracks with the closed slot extending parallel to and below the one of the tracks, each slot receiving one of the anchor bar ends therethrough;

each slot having an enlarged end aperture sized to receive therethrough and retain a portion of a bearing roller therein, the bearing roller having a first portion having a first diameter, a mid portion and a second portion having a diameter greater than the diameter of the first portion;

a carriage stop pin fastened to a distal end of each of the elongated spacer members, wherein the carriage stop pin extends through the closed slot; and a carriage stop fastened to the carriage stop pin.

* * * * *